United States Patent [19]

Nilsson

[11] 3,944,227

[45] Mar. 16, 1975

[54] SHOOTING TARGET WITH ILLUMINATING BULB

[75] Inventor: Thomas Nilsson, Angered, Sweden

[73] Assignee: Stiga AB, Tranas, Sweden

[22] Filed: Aug. 23, 1974

[21] Appl. No.: 500,002

[52] U.S. Cl. ..... 273/102.4

[51] Int. Cl.[2] ..... A63B 63/00

[58] Field of Search..... 273/102 R, 102 S, 102 PM, 273/102.4; 73/167; 272/8 M, 13; 240/130 C

[56] References Cited

UNITED STATES PATENTS

| | | | |
|---|---|---|---|
| 2,838,309 | 6/1958 | Merz | 273/102.4 |
| 3,334,902 | 8/1967 | Schwankert | 273/102.4 |
| 3,495,829 | 2/1970 | Booth | 273/102.4 |

FOREIGN PATENTS OR APPLICATIONS

| | | | |
|---|---|---|---|
| 649,320 | 12/1928 | France | 240/130 C |

*Primary Examiner*—Anton O. Oechsle
*Assistant Examiner*—Marvin Siskind
*Attorney, Agent, or Firm*—Toren, McGeady and Stanger

[57] ABSTRACT

A box like projectile catching device is provided with a front wall of translucent material located at an angle to the horizontal plane so as to deflect the projectiles. A light bulb is fitted inside the box and will illuminate the back face of a target fitted in front of the box, whereby hits made in the target may be observed by the shooter.

3 Claims, 4 Drawing Figures

SHOOTING TARGET WITH ILLUMINATING BULB

BACKGROUND OF THE INVENTION

The present invention refers to a target suitable for use with air rifles or other short distance weapons. Such targets are usually provided with means for preventing the ricocheting of the projectiles and to retrieve the same.

The aim of the present invention is to facilitate for the shooter to control the location of the hits during the firing of a series. With many short distance shooting galleries the target holder is mounted upon an endless track, so it is possible for the shooter to haul the target back to the stand on each occasion when it is desirable to control the hits. A simple arrangement for training a single shooter may include a fixed target, and here the shooter will have to walk up to the target each time he wants to look at the results.

Both manners are tedious and will of necessity impair the concentration of the shooter.

SUMMARY OF THE INVENTION

A projectile catching means of the ordinary type includes a box like structure having a bottom and front, back and side members, the front member being arranged at an angle of about 60° to the horizontal plane, whereby the projectiles are deflected and prevented from ricocheting back against the target.

According to the invention the possibilities of controlling the location of the hits from the stand is highly improved when the front member is made of tanslucent material, and at least one source of light is fitted within the box like structure.

DESCRIPTION OF SOME PREFERRED EMBODIMENTS

Figure 1:
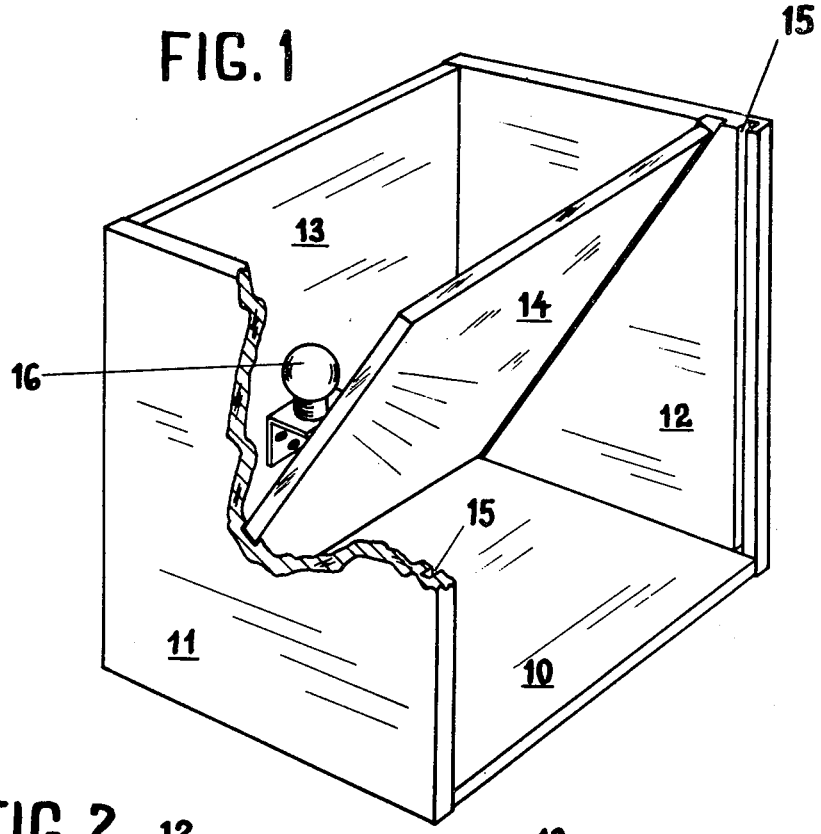
FIG. 1 is a perspective view, partly in section, of a combined target holder and projectile catching device.
Figure 2:
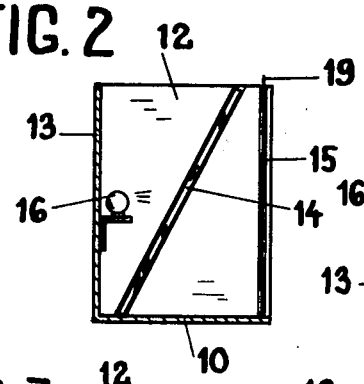
FIG. 2 shows, on a reduced scale a vertical section through the device according to FIG. 1.

The target holder and projectile catching device shown in FIGS. 1 and 2 includes a box like structure comprising a bottom 10, two side members 11 and 12 and a back member 13. These components may be made of wood, sheet metal, plastics or other suitable material. The inwardly turned surfaces of these components may be painted or treated in any other suitable way so as to reflect light.

The front member 14, which is fitted inside of the side members 11 and 12, is made of a translucent material, preferably a safety glass, for instance of the type marketed under the trade name MAKROLON, and is located at an angle of about 60° to the bottom or the box structure, said bottom being, in use, substantially horizontal. Projectiles passing through a target fitted in the holder will be deflected downwards and will then not bounce back and make further holes in the target.

In the present embodiment the device is adapted for use with air rifles and the thickness of the glass is selected with respect to the impact force of bullets from such rifles. With miniature rifles the glass would have to be thicker, or be provided with reinforcements.

Vertical grooves 15 are provided along the front edges of side members 11, 12, into which grooves a cardboard target may be fitted. In this embodiment the target holder and the projectile catcher form one unit.

A target often used with short distance shooting consists of a square piece of cardboard provided with five marks, each being a black spot surrounded by rings, one such mark being located centrally in the target and the others being located adjacent to each corner thereof.

A series may comprise one or more rounds against each mark and it is advantageous if the shooter, between each round can control the location of the hit. This is, according to the invention, made possible by fitting a light bulb 16, or some other source of light inside the box structure, behind its front member. The bulb will illuminate the back face of the target through the front member 14, and a hole made by a projectile will immediately appear. At least hits made within the black marks will be easily observed from the stand.

Figure 3:
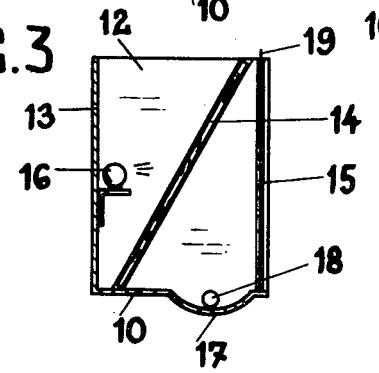
FIG. 3 shows a modified embodiment of the device.

The modified embodiment according to FIG. 3 corresponds substantially to that according to the one above described, but the bottom 10 is provided with a projectile retriever 17, which is connected to a removing means 18.

Figure 4:
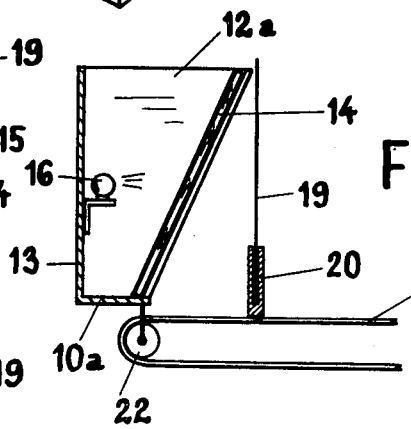
FIG. 4 shows a device suitable for use with a movable target holder.

The embodiment according to FIG. 4 is adapted for shooting galleries, where the target 19 is mounted in a holder 20 connected to an endless track 21. This runs over two sheaves, of which only one, 22, is shown in the drawing. By means of a crank (not shown) the target may be transported forwards and backwards between the shooting stand and the projectile catcher, which is fitted at a suitable distance from the stand. This arrangement is of conventional design, and the invention means that it now will be necessary to wind the target holder back to the stand for substitution of the target only, but not several times for control.

The projectile catcher is of basically the same type as described above. The bottom 10a, however, only extends to the lower edge of the front member 14, and the side members 11a and 12a, do only extend to the side edges thereof. The bottom member may of course also be formed as a projectile retriever as shown in FIG. 3, and in all embodiments a removable lid may be fitted which further concentrates the light emitted by the bulb. Some of the wall mebers for instance the side and the back member, or the lid, back and bottom members, may be formed integral as an arcshaped component, to act as a reflector.

The sheave 22 must not necessarily be mounted at the box structure, but may be fitted at a post carrying the box structure separately.

What I claim is:

1. A shooting target for use with air rifles or other short distance weapons comprising a box like structure which comprises a bottom member having a front edge and a back edge and a pair of spaced side edges extending between the front and back edges, a back member extending upwardly from the back edge of said bottom member, a pair of side members each extending upwardly from one of the side edges of said bottom member and a front member extending upwardly from said bottom member spaced from said back member and extending laterally between said side members, said front member disposed at an angle of about 60° to said bottom member with the surface of said front member facing away from said back member forming an acute angle with said bottom member, said front member being formed of a translucent material, a source of light located within said box like structure between said front and back members and intermediate said bottom member and the upper end of said front member, means for holding a target in alignment with said front and back members and located on the opposite side of said front member from said back member so that the light from said source of light passes through said front member and is directed on the surface of the target facing said front member while projectiles passing through the target strike said front member and are directed toward said bottom member by the sloping arrangement of said front member, and the translucent material of said front member having a strength sufficient to withstand the impact of projectiles of the type used in air rifles or other short distance weapons as the projectiles pass through the target.

2. A shooting target, as set forth in claim 1, wherein said means for holding a target comprises portions of said side members extending from said front member on the opposite side thereof from said back member and grooves formed in the portions of said side members with the grooves extending upwardly from said bottom member for holding a target therein.

3. A shooting target, as set forth in claim 1, wherein said means for holding a target comprises a holder spaced from said box like structure and located on the opposite side of said front member from said back member.

* * * * *